US005239019A

United States Patent [19]

Halling et al.

[11] Patent Number: 5,239,019

[45] Date of Patent: Aug. 24, 1993

[54] MODIFIED HYDROPHILIC POLYESTERS

[75] Inventors: Robert A. Halling, Wilmington, Del.; Davis E. Lee, Greenville, N.C.; Charles F. Palmer, Jr., Newark, Del.

[73] Assignee: E. I. Du Pont de Nemours and Company, Wilmington, Del.

[21] Appl. No.: 571,571

[22] PCT Filed: Mar. 6, 1989

[86] PCT No.: PCT/US89/00829

§ 371 Date: Sep. 7, 1990

§ 102(e) Date: Sep. 7, 1990

[30] Foreign Application Priority Data

Mar. 18, 1988 [GB] United Kingdom ..... 88/006419

[51] Int. Cl.[5] ..... C08F 20/00

[52] U.S. Cl. ..... 525/437; 528/272; 528/300; 528/301; 528/308; 528/308.7; 528/494; 528/495

[58] Field of Search ..... 525/437, 461; 528/494, 528/495, 272, 300, 301, 308, 308.7

[56] References Cited

U.S. PATENT DOCUMENTS

| | | | |
|---|---|---|---|
| 4,642,319 | 2/1987 | McDaniel | 521/175 |
| 4,767,810 | 8/1988 | Nelson | 524/56 |
| 4,925,890 | 5/1990 | Leung et al. | 524/133 |
| 4,977,191 | 12/1990 | Salsman | 521/48 |

*Primary Examiner*—Samuel A. Acquah

[57] ABSTRACT

A hydrophilic copolyester containing both polyoxyethylene diester and alkylene diester segments, and optionally containing other components, which copolyester has been modified after being formed by reaction with one or more polyols containing three or more hydroxy groups or one or more polyoxyethylene glycols or a mixture of one or more of such polyols and one or more of such glycols. The copolyester can be used in treating fibers and films.

11 Claims, No Drawings

MODIFIED HYDROPHILIC POLYESTERS

FIELD OF THE INVENTION

This invention relates to hydrophilic polyester copolymers modified by post-reaction to contain additional hydrophilic moieties. The resultant modified hydrophilic copolymers are useful for imparting desirable properties to various synthetic fibers and films.

BACKGROUND OF THE INVENTION

Polyester oligomers and copolymers containing significant quantities of hydrophilic moieties, are generally referred to as "hydrophilic" polyester oligomers or polymers and have been known for some time. They generally contain, sometimes along with other components, segments derived from low molecular weight glycols and segments derived from polyethylene oxides which impart the hydrophilic properties to the oligomer or polymer in which they are incorporated. They may be prepared by condensation, accomplished by heating to relatively high temperatures under relatively high vacuums, mixtures of diesters, simple glycols and polyethylene ether glycols. By-product alcohols and part of the alkylene glycol originally charged, are removed by distillation during the processing. The resulting copolyester probably consists of polyalkylene diester segments and polyoxyethylene diester segments randomly dispersed along the polymeric chain. Typically the copolyesters contain polyethylene terephthalate and polyoxyethylene terephthalate segments because of price and availability of the monomers, and similarity of structure to the high volume polyester fibers.

Copolyesters of the type discussed above, are disclosed in McIntyre et al., in U.S. Pat. Nos. 3,416,952, 3,557,039 and 3,619,269, which also describe the introduction of several other types of components into the polyester for application to fibers and films for enhancement of various properties. Similarly, Raynolds in U.S. Pat. No. 3,981,807, reports a variety of modified copolyesters for application to textiles. Gillberg-LaForce et al., in U.S. Pat. No., 4,569,974, describe hydrophilic copolymers containing polyhydroxy moieties derived from such compounds as pentaerythritol, glycerin and their low molecular weight oligomeric ethers. Gosselink et al., in U.S. Pat. Nos. 4,702,857, 4,711,730 and 4,713,194, disclose hydrophilic copolyesters prepared from diesters, low molecular weight diols and polyalkylene oxides capped at one end with an ether group, for use as soil release agents in detergent compositions. Gosselink also discloses in U.S. Pat. No. 4,721,580, copolyesters derived from diesters, low molecular weight diols and polyalkylene oxides capped at one end with a salt of a sulfonic acid, for the same application. Teijin EP 159882 describes as useful for incorporating polyester fibers into paper-making, hydrophilic copolyesters prepared from diesters of tere- or isophthalic acid, a low molecular weight glycol, a polyethylene glycol and a salt of a sulfonated phthalic acid. ICI Americas EP 66944 describes similar copolymers which may also contain aliphatic diester moieties and which are useful as textile treating agents.

BRIEF SUMMARY OF THE INVENTION

The present invention provides hydrophilic polyester copolymers modified by post-reaction to contain additional hydrophilic entities. These novel compositions are useful for imparting certain properties to synthetic fibers on which they are applied.

DETAILED DESCRIPTION OF THE INVENTION

The present invention is based on the discovery that when some of the known hydrophilic copolyesters (which contain both alkylene diester and polyoxyethylene diester repeating units in their structure) are post-reacted chemically with additional hydrophilic entities, the resultant novel copolymers impart novel properties to, or enhance existing properties of, fibers to which they are applied. The resultant modified hydrophilic copolyesters are novel because of their novel structure which results from the manner in which they are synthesized. By preparing them by consecutive reactions, the additional hydrophilic entities being introduced into the copolyester molecules tend to be concentrated at the ends of the newly formed modified copolymer segments rather than being randomly distributed throughout the polymer chain (as it would be if it were introduced with the reactants being used to synthesize the known hydrophilic copolyester).

The known hydrophilic copolyesters of this invention which are used as the base copolymers for post-reaction with additional hydrophilic entities, may be any of those discussed above. They may be simple copolyesters, i.e., they may contain only polyalkylene diester and polyoxyethylene diester segments, the copolyester being derived from a single glycol, polyethylene oxide and diester. Ethylene glycol, dimethyl terephthalate and polyethylene oxides of various molecular weights are the most common raw materials for these copolymers, mainly because of cost and availability. Numerous variations on the comonomers used to prepare these simple hydrophilic copolyesters are possible. Other alkylene glycols such as propylene and butylene glycols are suitable for the replacement of all or part of the ethylene glycol, or they may be incorporated in minor amounts into the polyethylene oxide employed. Simple ether glycols such as diethylene glycol, and cycloaliphatic diols such as 1,4-cyclohexane dimethanol, are also appropriate as comonomers for the base copolyesters. Among other diesters that may be used to replace all or part of the dimethyl terephthalate are diesters of aliphatic diacids such as adipic and sebacic acids, and of aromatic diacids such as isophthalic and sulfonated isophthalic acids. The base copolymers of this invention may additionally contain one or more of the other components described in the prior art, e.g. an acidic group, a basic group, an ionizable salt group, an antioxidant group, a group that absorbs ultra-violet light, a group which imparts water-repellency, a dyestuff group and polymeric groups containing a plurality of either hydroxy groups or amido groups, all of which are disclosed by McIntyre et al., supra. The other references cited include still other types of moieties that may be optionally introduced into the copolymer.

The molar ratio of the alkylene diester segments to the polyoxyethylene diester segments in the base copolymers of this invention, may vary from about 0.5:1 to 10:1. The range of about 1:1 to 6:1 is preferred, with the range of about 1:1 to 3:1 being most preferred. Other components, added to produce a variety of effects as described above, usually amount to about 10% or less by weight, if present at all.

The post-reactants of this invention are hydrophilic in nature. They consist of polyols containing three or more hydroxy groups, and polyoxyethylene glycols. The polyols may also contain other functional groups such as, e.g., ester and ether groups. Examples of polyols suitable for use in this invention include simple polyols such as glycerin, pentaerythritol and sorbitol, low molecular weight ether polyols derived from the simple polyols such as diglycerol and di- and tripentaerythritol, and polymeric polyols such as the partially hydrolyzed polyvinyl acetates and partially esterified derivatives of cellulose. Ethylene oxide adducts of the above polyols are also suitable for use in this invention. The polyoxyethylene glycols suitable for use in this invention, may vary in molecular weight from about 300 to 6,000, depending on the intended application. Molecular weights of about 600 to 3,000 are preferred, with 800 to 1600 being most preferred. Besides their hydroxy and ether segments, they may optionally contain other functional groups such as amino groups and quaternized amino groups.

The amounts of post-reactants added to the base copolymers to modify them may vary, depending on the intended application and the type of reagent employed. For example, they may range from about 1% of the base copolymer to about 40% by weight, or even higher. Usually 2 to 20%, by weight, results in the desired effects.

The modified copolyesters, i.e., those that have been post-reacted with additional hydrophilic entities according to this invention, are useful in imparting various useful surface properties to synthetic fibers. They may be applied to the fibers ty themselves or together with crosslinking agents such as esters of aliphatic diesters or other reactive di- or polyfunctional reagents.

As mentioned above, the base copolyesters of this invention are prepared by condensation at relatively high temperatures under reduced pressures. Temperatures of about 200° to 280° C., or even higher, and pressure not higher than about 35 mm Hg are generally employed. By-product alcohols and part of the low molecular weight glycols originally charged are removed by distillation during the condensation process. As the process proceeds the viscosity of the base copolyester increases. If a post-reactant such as sorbitol were added to the condensation reaction mixture used to prepare the base copolyester, an intractable mass would be obtained, because the polyfunctionality of sorbitol would cause extensive three-dimensional crosslinking.

The post-reaction of the base copolyester with additional hydrophilic entities, as described in this invention, is carried out under milder conditions than those used in synthesizing the base copolyester. Most are carried at temperatures of about 150° C. or above, at atmospheric pressure, with temperatures of 180° to 200° C. being preferred. In some cases, as in the post-reactions described in Examples 13 and 14, vacuum is also applied, but the over-all conditions are less vigorous than in the preparation of the base copolyesters. Additionally, when the post-reactant is charged to the heated base copolymer, a reduction in viscosity may initially occur, indicating a reduction in the average molecular weight of the polymer. As the post-reaction proceeds, the viscosity of the mass may increase. However, the post-reaction of this invention is not carried out long enough or under sufficiently severe conditions so as to result in an intractable mass. We visualize that the post-reactant splits the base copolyester at the ester sites, leading to lower molecular weight species having the post-reactant segments concentrated at the ends of the polymeric chains. This affords different results than if the post-reactant were added to the original preparation of the base copolymer in which case its segments would be randomly located and crosslinked throughout the polymer molecule producing an intractable mass.

The following examples are given in further illustration of the invention but not by way of limitation.

BASE COPOLYESTER 1

Base copolyester 1 was prepared with a molar ratio of dimethyl terephthalate/polyethylene ether glycol(mw=1,000)/ethylene glycol/pentaerythritol of about 1.0/0.5/0.46/0.04 according to the following recipe using conventional techniques at temperatures of about 200° to 240° C. and vacuums of about 35 mm Hg or less:

| Ingredients | Wt. |
|---|---|
| Dimethyl terephthalate | 1069 |
| Ethylene glycol | 687 |
| Polyethylene glycol (mw 1,000) | 2539 |
| Pentaerythritol | 30 |
| Zinc acetate dihydrate | 3.5 |
| Lithium acetate dihydrate | 3.5 |

EXAMPLE 1

Base Copolyester 1, 90 g, was introduced into a dry flask equipped with a stirrer, a condenser, a thermometer and a nitrogen inlet. The copolyester was heated to 150° C. under a nitrogen sweep. There were then added 2 g of sorbitol and the temperature was increased to 180° C. The reaction mass was stirred at about 180° C. for 8 hours under a nitrogen sweep. The resultant product was allowed to cool to 110° C. and was poured into 478 g of rapidly agitated water containing 9 g of a nonionic dispersing agent. The mixture was vigorously agitated for 30 minutes. It was then homogenized to produce a fine dispersion of about 15% active ingredients. The resulting emulsion was diluted and applied to polyester fiber fill where it was found to be effective in imparting slickness.

EXAMPLES 2 to 11

Base Copolyester 1 was similarly post-reacted with the materials indicated in TABLE 1.

TABLE 1

| Example No. | Post Reactant | Post Reactant, weight % |
|---|---|---|
| 2 | Sorbitol | 4 |
| 3 | Sorbitol | 6 |
| 4 | Sorbitol.5EO(adduct with 5 moles of ethylene oxide) | 4 |
| 5 | Pentaerythritol | 4 |
| 6 | Polyvinyl alcohol, 75% hyd., mw = 2,000 | 5 |
| 7 | Tripentaerythritol | 10 |
| 8 | Polyethylene ether glycol, mw = 1500 | 10 |
| 9 | Cellulose monopropionate, medium mol. wt., density 1.23, flow temp. 329° F. | 2 |
| 10 | C18 amine.16EO* quaternized with dimethyl sulfate | 10 |
| 11 | C12 amine.10EO** quaternized | 20 |

TABLE 1-continued

| Example No. | Post Reactant | Post Reactant, weight % |
|---|---|---|
| | with benzyl chloride | |

*Tallow amine, predominantly C18, reacted with 16 mols of ethylene oxide.
**cocoamine, predominantly C12, reacted with 10 mols of ethylene oxide.

The products from Examples 2 through 11 were found to impart slickness to polyester fiberfill and hydrophilic characteristics to polyester staple.

EXAMPLE 12

Base Copolyester 1 was post-reacted with 2% by weight of sorbitol under a nitrogen sweep for 2 hours at 180° C. and atmospheric pressure, followed by 3 hours at 180° C. at a pressure below 35 mm Hg with continued nitrogen sweeping to yield a fluid tractable product which was an effective slickener for polyester fiberfill.

EXAMPLE 13

Example 12 was repeated using 6% by weight of sorbitol. The resultant product was effective as a hydrophilic treatment for polyester staple.

EXAMPLE 14

Base Copolyester 2 was prepared similarly to Base Copolyester 1, with a molar ratio of dimethyl terephthalate/polyethylene glycol(mw=1,000)/ethylene glycol/pentaerythritol of about 1.0/0.7/0.26/0.04. It was post-reacted with 2% by weight of sorbitol in the same manner as described in Example 11, leading to a product which was effective as a slickener for polyester fiberfill.

EXAMPLE 15

Base Copolyester 3 was prepared similarly to Base Copolyester 1, with a molar ratio of dimethyl terephthalate/polyethylene glycol(mw=1,500)/ethylene glycol/pentaerythritol of about 1.0/0.5/0.46/0.04. It was post-reacted with 2% sorbitol in the same manner as described in Example 1 leading to a product which was effective as a slickener for polyester fiberfill.

EXAMPLE 16

Base Copolyester 4 was prepared similarly to Base Copolyester 1, with a molar ratio of diethyl sebacate/polyethylene glycol(mw=1,000)/ethylene glycol/pentaerythritol of about 1.0/0.5/0.46/0.04. It was post-reacted with 10% by weight of polyethylene oxide, mw=1,000, in the same manner as described in Example 1.

We claim:

1. A composition comprising a hydrophilic polymeric copolyester consisting essentially of both polyoxyethylene diester and alkylene diester segments, which copolyester has been modified after being formed by reaction with one or more polyols containing three or more hydroxy groups or one or more polyoxyethylene glycols or a mixture of one or more of such polyols and one or more of such glycols so as to provide the copolyester with from about 1 to about 40 weight percent of post-reactant segments.

2. The composition of claim 1 wherein said polyols contain ester groups.

3. The composition of claim 1 wherein said polyols contain ether groups.

4. The composition of claim 1 wherein said polyoxyethylene glycols contain amino groups.

5. The composition of claim 4 wherein said amino acids are quaternized.

6. The composition of claim 1 wherein said copolyester contains between about 2 and about 20 weight percent of post-reactant segments.

7. The composition of claim 1 wherein the mol ratio of said polyoxyethylene:alkylene segments is in the range between about 0.5:1 and 10:1.

8. The composition of claim 7 wherein said ratio is in the range between about 1:1 and 6:1.

9. The composition of claim 8 wherein said ratio is in the range between about 1:1 and 3:1.

10. The composition of claim 1 wherein said hydrophilic copolyester consists essentially of polyethylene terephthalate segments and polyoxyethylene terephthalate segments.

11. The composition of claim 1 wherein said hydrophilic copolyester has been post-reacted with sorbitol.

* * * * *